United States Patent [19]

Jespersen

[11] 4,236,679

[45] Dec. 2, 1980

[54] FLEXIBLE SHEET MATERIAL ROLL DISPENSING

[75] Inventor: Paul W. Jespersen, Houston, Tex.

[73] Assignee: Georgia-Pacific Corporation, Portland, Oreg.

[21] Appl. No.: 50,517

[22] Filed: Jun. 21, 1979

[51] Int. Cl.[3] ..... B65H 19/06

[52] U.S. Cl. ..... 242/55.53; 242/55.3; 312/39

[58] Field of Search ..... 242/55.53, 55.3; 226/127, 128, 129, 130; 312/38, 39

[56] References Cited

U.S. PATENT DOCUMENTS

| | | | |
|---|---|---|---|
| 2,334,689 | 11/1943 | Wooster | 242/55.53 |
| 2,758,800 | 8/1956 | McCants | 242/55.3 |
| 2,924,494 | 2/1960 | Sloier | 312/39 |
| 3,217,953 | 11/1965 | Bahnsen | 226/127 X |
| 3,865,295 | 2/1975 | Okomura | 242/55.3 |

*Primary Examiner*—Edward J. McCarthy
*Attorney, Agent, or Firm*—Schuyler, Banner, Birch, McKie & Beckett

[57] ABSTRACT

Dispensing flexible sheet material involves mounting at least one roll on dispensing arm means pivotally connected to a dispenser near the lower end of the chassis so that as material on the roll is depleted the concomitant diminishing diameter roll will swing down on the dispensing arm means for the roll axis to move through an arc spaced from the axis of the feed roller to wedge the roll surface firmly against the surface of the feed roller as the axis of the roll moves toward a line extending through the feed roller axis and the pivotal axis where the dispensing arm means is connected to the chassis. When the roll is essentially depleted it swings past the line and the feed roller into a discard area. Dispensing from multiple rolls in succession utilizes an initial roll mounted as above described and a reserve arm means connected to the chassis through means which permits the reserve arm means to move down vertically relative to the chassis as the initial roll is depleted to a lower position where the reserve arm means thereupon pivots relative to the chassis and the reserve roll engages with the feed roller when the essentially depleted initial roll swings into the discard area to swing through an arc similar to that which the initial roll moved through as the roll diameter diminished.

12 Claims, 6 Drawing Figures

FIG. 3
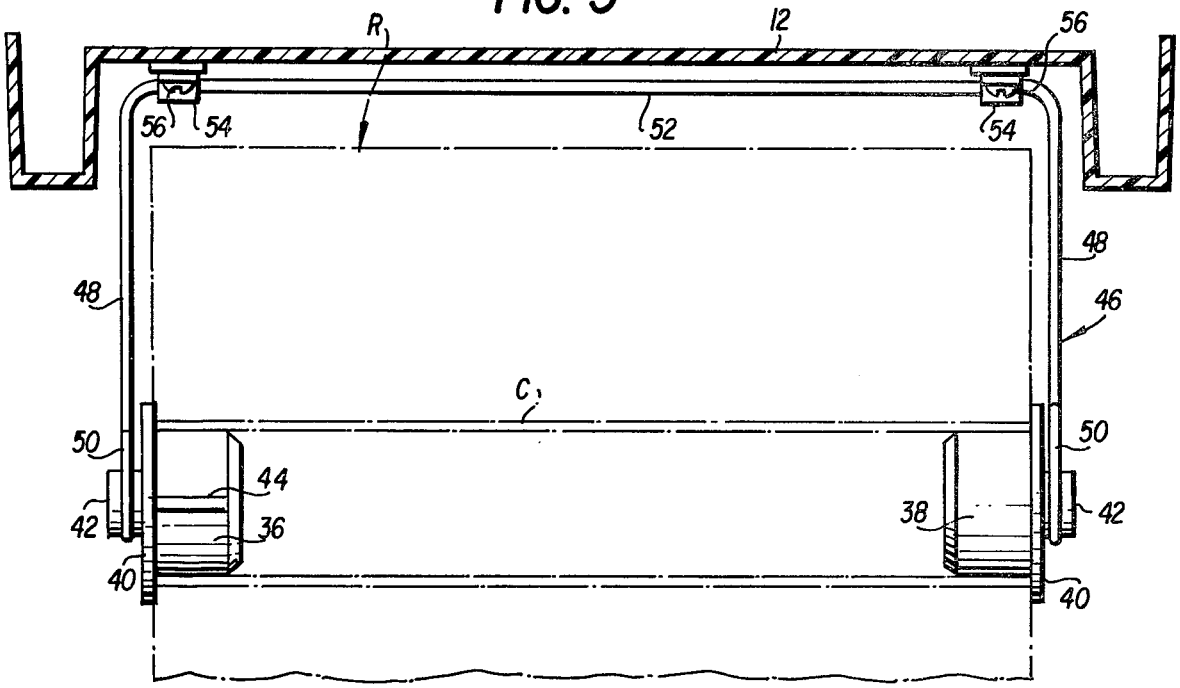
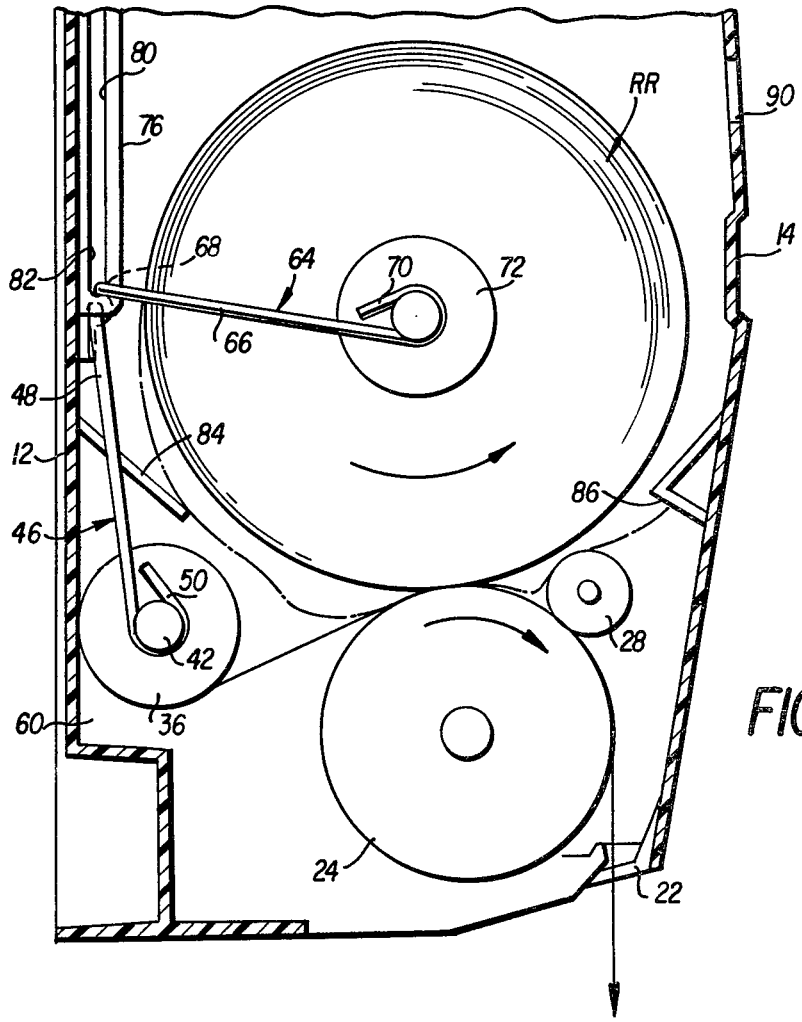
FIG. 6

FLEXIBLE SHEET MATERIAL ROLL DISPENSING

BACKGROUND OF THE INVENTION

The invention relates to dispensing flexible sheet material from wound rolls of material, such as paper towels. Particularly, the dispensing of this invention relates to paper towels, tissue paper and like rolls wherein each roll has a hollow central core and is inserted in the dispenser by mounting means carried within the dispenser to engage the opposite ends of the roll core.

The dispensing of a web of flexible sheet material may be carried out in accordance with the instant invention with either a single wound roll or multiple rolls retained for dispensing. Where multiple rolls are dispensed, this is performed on the rolls in succession with unwinding of the material from each roll and assurance that the leading free end on the exterior of the wound roll will feed into the dispensing mechanism with reliability so that the user will have accessibility to the sheet material exteriorally of the dispenser.

Where dispensers of paper towels in roll form are used, the dispenser is generally mounted on a wall in a location where towel availability is desired. In commercial uses large numbers of such dispensers are employed in installations such as factories, office buildings, institutions, etc. Recently, more and more attention has been devoted to consideration of the substantial time and expense required by personnel servicing the large number of dispensers in replenishing the exhausted wound rolls in such dispensers. This is a sizable problem where a single roll is the limit of capability for storage within the dispenser. Still, with a single or multiple roll dispenser, if proper and effective feeding of the towel material from the dispenser is not achieved and/or the material breaks, the dispenser is rendered useless until the malfunction is corrected. But, there are many applications wherein the cost and size of a multiple roll dispenser is not needed and accordingly a dispenser capable of handling only a single roll is fully adequate in the location where towel use is desired.

One of the problems in prior art dispensing of sheet material from a roll by use of a dispenser has been the importance of insuring that the sheet material, such as web of toweling, is positively dispensed out of the dispenser whether it be a single roll dispenser or a multiple roll dispenser. In many applications the gravity of the problem increases as the sheet material is drawn off of the roll and the material is depleted from the roll with concomitant diminishing roll diameter. Thus, the weight and diameter of a full roll in a dispenser, where the roll is resting on a feed roller disposed adjacent the lower end of the dispenser chassis may provide sufficient weight for the material to be firmly pressed against the feed roller and the roll and feed roller will properly rotate together and assure proper feeding of the material out of the usual opening provided at the bottom of a dispenser. When the material on the roll becomes substantially depleted, obviously the weight of the roll pressing down on the feed roller becomes less and less. This means that less pressure is applied against the surface of the feed roller and slippage, failure of feed of the web material from the dispenser or breakage of the material within the dispenser may occur such that the user is thwarted from obtaining the desired towel material.

Whether the dispensing apparatus contemplates single or multiple rolls to be handled by the dispenser it is important that the structure be simple and effective. Attendants who are charged with reloading dispensers could become confused with structures involving complicated dispensing mechanisms and thus the dispenser must be readily understandable and adaptable to easy loading by these attendants. Where threading of even the single lead end of the initial wound roll may be overly complicated with complex dispensers, loading and assurance that the web material is properly placed and that it will continue to feed even though the roll diameter materially diminishes as the material is drawn off of the roll become highly important features in both commercial single or multiple roll dispensers.

SUMMARY OF THE INVENTION

The dispenser of the instant invention is adaptable for incorporation into either single or multiple roll dispenser embodiments. In either case, the dispenser incorporates a feed roller rotatably mounted at the lower end of the dispenser chassis. A full roll of flexible sheet material in dispensing position rests on the upper surface of this feed roller and in a multiple configuration of the dispenser a reserve roll will be mounted to rest on the upper surface of this initial roll in the dispensing position.

Importantly, the mounting mechanism for the roll in the dispensing position whether it be the initial roll or subsequently the reserve roll once the initial roll has been depleted, provides that, as the material on the roll is depleted with concomitant diminishing roll diameter and of course decreasing weight of the roll pressing down on the feed roller, the mounting mechanism will assure that the pressure, even with diminishing weight of the roll in the dispensing position, increases to at least compensate for the decreased weight. Also, the extent or length of flexible sheet material passing over the feed roller increases with decrease in the roll diameter. Both of these factors encourage trouble-free and effective feed of the sheet material out of the dispenser.

When the roll, located in the dispensing position, has been essentially depleted of sheet material, it moves under control of the mounting mechanism away from contact with the feed roller and into a discard area within the dispenser chassis. In a multiple roll embodiment incorporating similar mounting mechanism for each roll, the reserve roll moves down into driving contact with the feed roller when the initial roll has passed into discard. The same action occurs with reference to the reserve roll, in that as it diminishes in diameter upon depletion of sheet material from the roll, the decreasing weight of the roll is compensated for by the mounting mechanism increasing the pressure of the reduced diameter and lighter weight roll against the feed roller. Again the extent of wrap of the sheet material over the circumference of the feed roller is increased as the sheet material is withdrawn and the roll diameter diminishes.

To promote the smooth feed of sheet material from the dispenser, a pinch roller is preferably biased against the surface of the feed roller with the sheet material passing between the rollers on its way to egress from the dispenser.

With the foregoing in mind, it is a principal object of the present invention to provide a flexible sheet material dispenser having improved mounting for one or more rolls producing an added feed pressure for the roll in dispensing position against a feed roller to promote effective dispensing even when the wound roll diminishes to a point where essentially all of the wound material has been withdrawn therefrom.

An important object of the invention is to provide a wound roll mounting mechanism which may be employed in either a single roll dispenser or, by slight adaptation, utilized in a multiple roll dispenser wherein in either instance the pressure of the roll against the feed roller and the wrap of the sheet material around the feed roller is increased as the roll in dispensing position diminishes in diameter upon withdrawal of material from the dispenser by the users.

These and other objects of the invention will become apparent upon consideration of the detailed description of preferred embodiments of the invention given in connection with the following described drawings which form a part of this application.

BRIEF DESCRIPTION OF THE DRAWINGS

FIG. 3 is a sectional view taken on line 3—3 of FIG. 1.

FIG. 6 is a partial side view with portions in section and the chassis side removed to display the manner in which the leading end of wound material on a roll is assured to be picked up on the feed roller for egress from the dispenser.

DESCRIPTION OF PREFERRED EMBODIMENTS OF THE INVENTION

Figure 1:
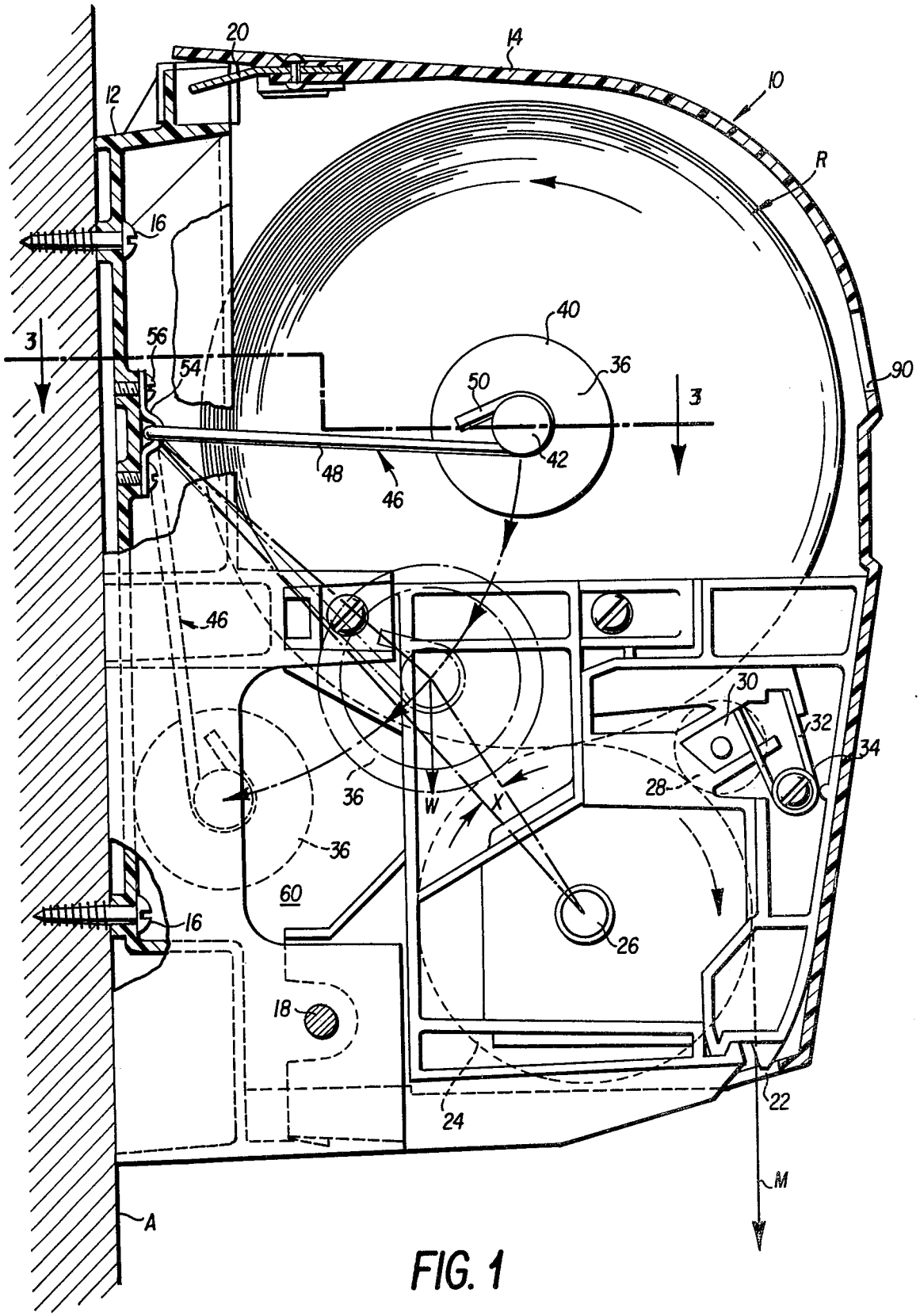
FIG. 1 is an end view of a single roll dispenser with portions of the chassis, backplate and cover shown in section to expose some elements within the dispenser.
Figure 2:
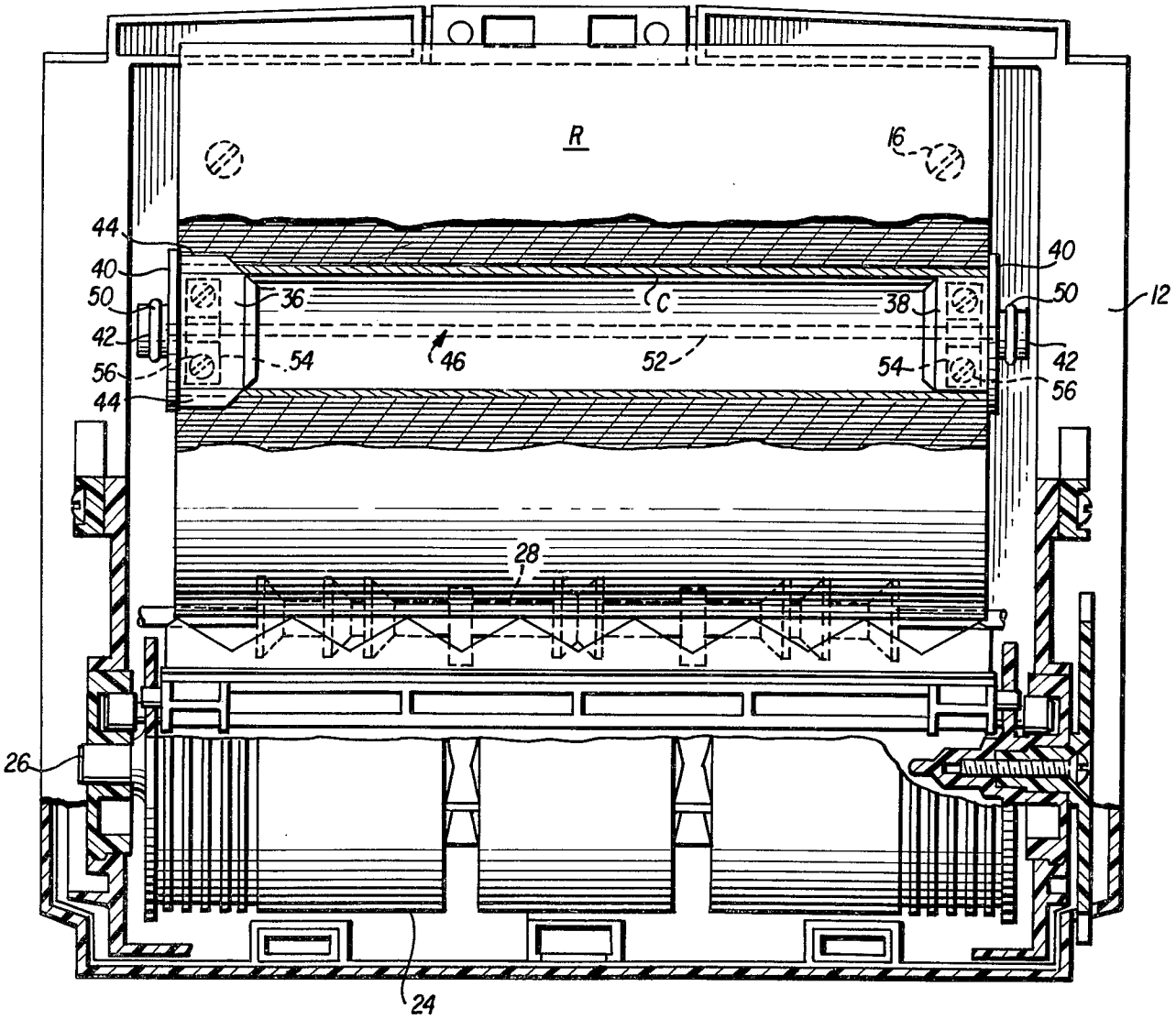
FIG. 2 is a front elevation of the dispenser of FIG. 1 with the chassis cover removed and portions shown in section.
Figure 4:
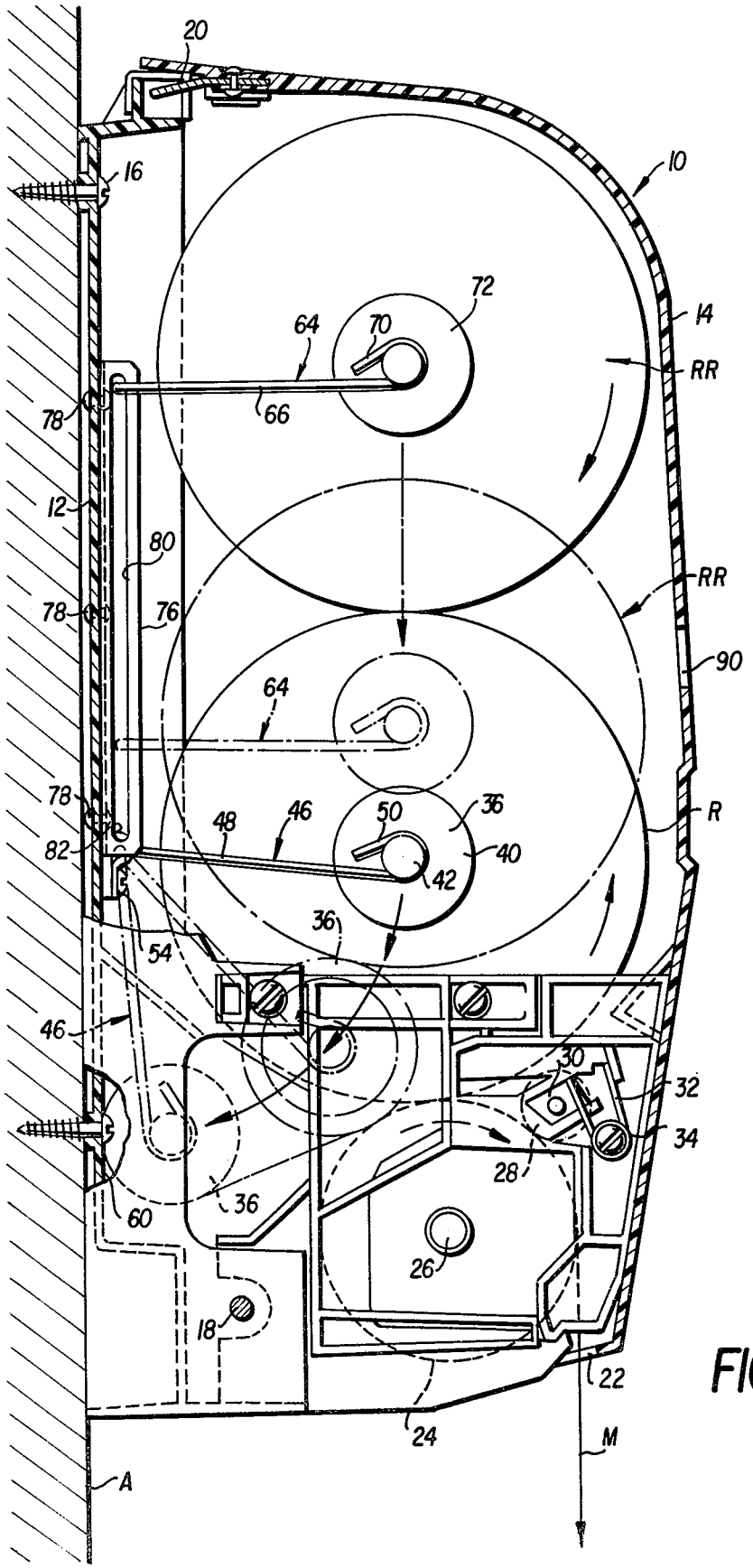
FIG. 4 is a view similar to FIG. 1 but showing a multiple roll dispenser incorporating the invention.
Figure 5:
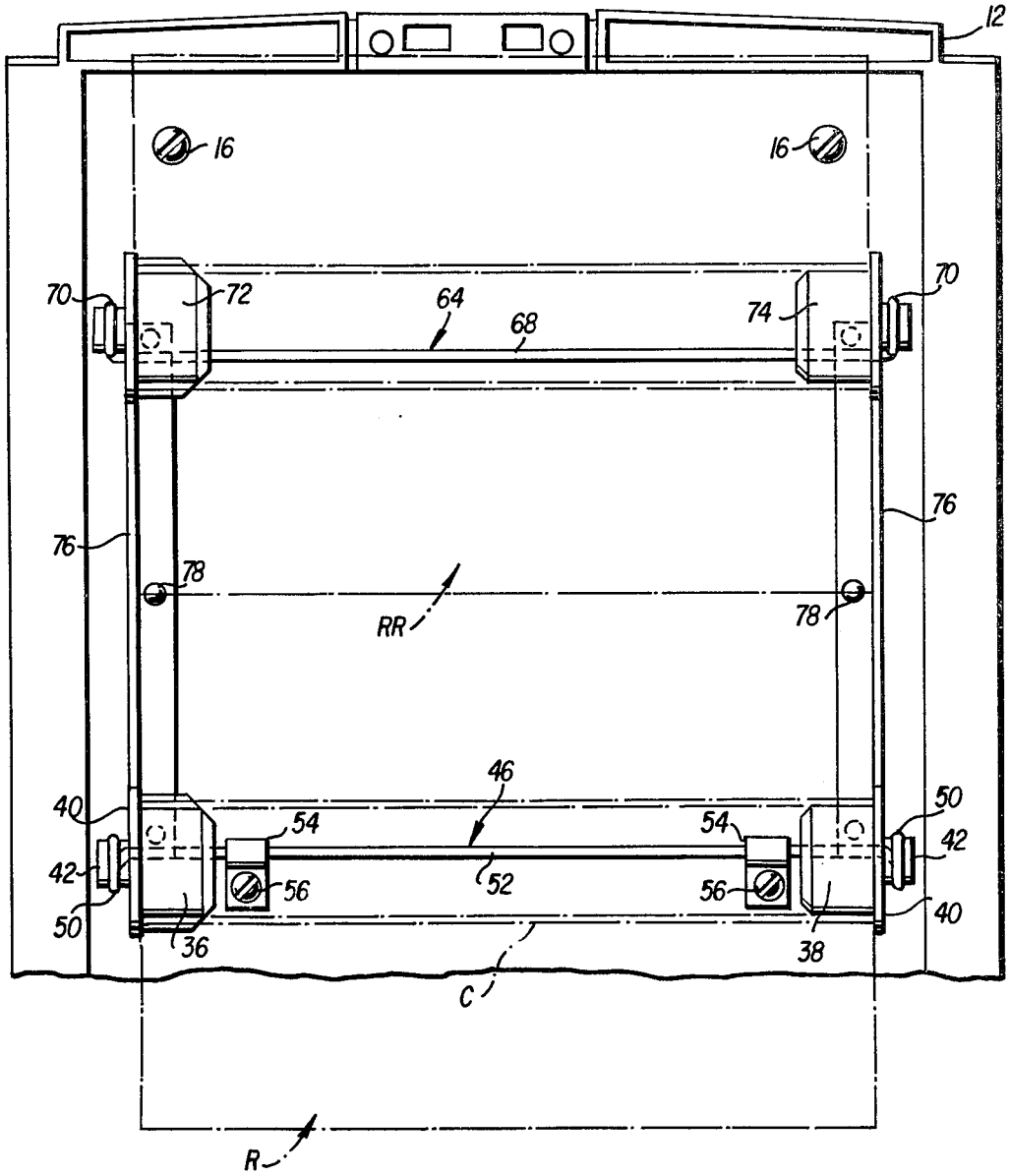
FIG. 5 is a partial elevational view of the dispenser shown in FIG. 4 with the cover removed and the rolls absent from the dispenser portion shown.

There are two preferred embodiments illustrated on the drawings. FIGS. 1, 2 and 3 show an embodiment for a dispenser accommodating a single roll of flexible wound sheet material. FIGS. 4, 5 and 6 disclose a second embodiment which accommodates two rolls of flexible wound material one being disposed in a dispensing position and the other in a reserve position located above the first roll. However, the concepts of the invention are equally utilized and employed in each of the two embodiments. Thus, although the embodiments are separately described hereinafter, it will be understood that the salient features of the invention are incorporated in each embodiment.

Considering the embodiments shown in FIGS. 1, 2 and 3, the dispenser 10 has a chassis including a backplate 12 and a cover 14. When installed for use, the backplate 12 is secured to a wall A by suitable screws 16 passing through the backplate 12 and screwed into the wall A. The cover 14 is hingedly secured at its lower end to backplate 12 by pivots 18. Thus the cover 14 may be swung open from the backplate 12 to expose the interior of the chassis for removal of spent roll cores from the discard area as will be described and for loading new fresh rolls of wound sheet material into the dispenser. A suitable latch 20, (not shown in detail) is provided adjacent the upper end of cover 14 to latchingly engage with backplate 12 to hold the cover in place once it has been unloaded and properly loaded.

An opening 22 is provided between the cover 14 and backplate 12 at the lower end of dispenser 10 through which the web of towel is dispensed to the intending user.

A feed roller 24 having an appropriate friction surface is mounted on the backplate sidewalls as by means of a mounting spindle 26 at one end and mounting structure as best shown in FIG. 2 at the opposite end. The feed roller 24 has its forward peripheral portion, away from the wall W, disposed to overlie the opening 22 such that the flexible material M will egress through the opening 22 of the dispenser. Thus, upon forward rotation of the feed roller 24 the web of sheet material M will be fed out of opening 22. A pinch roller 28 is rotatably mounted in bearing blocks 30 at its opposite ends. The bearing blocks 30 mounting pinch roller 28 are suitably supported in stationary slides so that the pinch roller may yieldably move toward and away from the surface of the feed roller 24. The bearing blocks 30 are spring biased toward feed roller 24 by a spring 32 at each end of the pinch roller 28, each spring being mounted on a suitable screw 34 carried by one of the backplate sidewalls.

The mechanism for feeding and guiding the web of sheet material M from roll R out through opening 22 is not part of the instant invention. Numerous different mechanisms may be adapted to work with rollers 24 and 28. The feed roller 24, pinch roller 28, slide mounted blocks 30 biased by the pinch roller springs 32 and screws 34 are more fully illustrated and described in a prior application of Raymond F. DeLuca Ser. No. 897,431, filed Apr. 18, 1978 and commonly assigned to Georgia-Pacific Corporation. Thus, for a fuller understanding of the functioning of the feed roller and pinch roller in reference to feeding sheet material from a roller dispenser reference should be made to this earlier application. Accordingly, detailed description of the feed mechanism construction is not deemed to be necessary for inclusion herein. The disclosure of the above identified earlier application is incorporated herein by reference.

The mounting means for the roll of flexible sheet material R is provided by a pair of cups 36 and 38. Each cup fits snugly within an end of core C at the center of the roll of material and on which the web of flexible sheet material is wound. Each of cups 36 and 38 is provided with a flange 40 and has an outwardly projecting center stub shaft 42 by means of which the cup is rotatably connected to the dispensing arm yoke as will be described. Flanged cup 36 differs from cup 38 at the opposite ends of roll core C in that cup 36 is provided with radial flanges 44. The roll R and specifically the core C of such roll is radially slotted at one end to receive the radial fins 44 in the manner as shown in FIG. 2. The purpose and function of the fins 44 and slotting of the roll at one end is to assure that the roll will be properly inserted into the dispenser since only the slotted end of the roll can accommodate the fins 44. Thus, orientation of the roll R for proper feeding from the dispenser is ensured by the slotted end of the roll being mated with the radial fins 44 on cup 36. Obviously, the roll could not be inserted in a different end-to-end relationship since the opposite end of the roll is not slotted and therefore it could not accommodate the radial fins 44 on cup 36.

The roll R in the dispenser embodiment of FIGS. 1, 2 and 3 is supported on a generally U shaped yoke 46. The yoke has parallel arms 48, each provided with a loop 50 at its outer end. The inner ends of arms 48 are connected together by a member 52 to form the U shape as clearly shown in FIG. 3. The interconnecting member 52 with the arms 48 completes the yoke 46. This interconnecting member 52 of the yoke is pivotally mounted onto the backplate 12 of the dispenser chassis by clips 54 secured to the backplate by screws 56.

The loops 50 on the outer ends of yoke arms 48 engage in grooves formed in the stub shafts 42 of the cups 36 and 38 which cups in turn engage in the opposite ends of the core C of roll R. The yoke 46 is made of a spring like material, like steel wire, such that the cups 36 and 38 on arms 48 may be sprung apart for a roll R to be placed therebetween and the spring action of arms 48 released. The cups 36 and 38 then move toward each other to enter into the opposite ends of core C for the roll R and thus firmly and securely support the roll on yoke 46 within the dispenser 10.

Adjacent the lower end of the dispenser 10, immediately forward of the backplate 12 and behind the location of feed roller 24 there is provided a discard area 60 to receive essentially spent or depleted rolls of sheet material. In the final usage of the sheet material from a roll effectively only the cure C of the roll will be left in the discard area 60. As shown in FIG. 1, the position of an essentially depleted roll of web material is shown in phantom lines within the discard area 60. It will be noted that the core of the spent roll, still suspended on the arms 48 of yoke 46, is shown in dotted lines on FIG. 1 in the discard area 60.

Before proceeding with description of the second perferred embodiment having a capability for dispensing multiple rolls, description may be given of the functioning operation of the single roll dispenser 10 shown in FIGS. 1, 2 and 3.

In loading the dispenser 10, the spring arms 48 of yoke 46 are spread apart such that the roll R may enter between the cups 36 and 38. Then the arms 48 are released and the cups enter the core C of the roll. The roll is loaded so that it unwinds from the bottom of the roll as the paper is pulled toward the front of the dispenser 10. This proper loading and avoidance of a roll being loaded backwards is facilitated by the fins 44 on cup 36 which can only enter the slotted end of a roll such as shown in FIG. 2. The end of the web of material from the roll is then lead across the top of feed roller 24, between the feed roller 24 and pinch roller 28 and then out of the dispenser through opening 22.

It will be readily recognized that the pivotal mounting of yoke 46 on the back plate 12 of dispenser 10 allows the full weight of the roll R to rest on the upper surface of feed roller 24. As the web of material is pulled from the dispenser the yoke 46 will pivot about its mounting by clips 54 so that as the material is depleted from the roll with concomitant diminishing of the roll diameter, the roll will gradually move from its full roll condition as shown in FIG. 1 to an essentially depleted condition as shown in FIG. 1 in phantom lines. While the essentially depleted roll is now of a much lighter weight, the arrow W shows the weight now applied pressing the essentially depleted roll down against the feed roller 24.

When the roll, held at a fixed distance from pivot clips 54 on yoke arms 48, is still slightly too large to drop past the feed roller 24, it is at a position such as depicted by the phantom line showing and the weight line acting downwardly identified by W. At this point there is what might be described as a toggle action due to the weight W of the essentially depleted roll and the angle identified X between a line extending through the feed roller and roll axes and another line extending through the feed roller axis and the pivotal axis whereat the yoke 46 is connected to the dispenser backplate 12. However, even the slight weight of the nearly depleted roll acting in the direction of arrow W and with angle X having a magnitude greater than zero gives a substantial magnification of the pressure of this nearly spent roll on the surface of the feed roller 24. The small diameter roll wedges down against feed roller 24. This pressure increases as the roll diameter diminishes and the towel weight decreases due to the gradual decrease in the magnitude of angle X, thus maintaining the needed pressure and friction to continue the dispensing action from the nearly spent roll and feed roller 24.

If additional friction is needed, this can be easily provided by adding a light spring (not shown) to urge yoke 46 downwardly.

It also is to be noted that as the roll reduces in diameter to the position shown in phantom lines in FIG. 1, it not only moves further back into the dispenser towards the discard area 60 but also the length or wrap of the web material overlying the friction surface of feed roller 24 gradually increases. This, in turn, further increases the turning force on the feed roller and effectiveness of the web feeding operation.

When the axis of an essentially depleted roll has moved to the line extending through the axis of feed roller 24 and the pivot axis of yoke 46 on the backplate 12, i.e. when the magnitude of angle X has been reduced to zero, the spent roll swings down, past and away from the surface of feed roller 24. Thus, it is guided into the discard area 60 on yoke arms 48 as shown for the roll in dotted lines resting against the backplate 12 illustrated in FIG. 1.

Reference may now be made to FIGS. 4, 5 and 6 wherein there is illustrated a multiple roll embodiment incorporating essentially the same principles for dispensing as have heretofore been described for the single roll embodiment shown in FIGS. 1, 2 and 3. The chassis for this embodiment is quite similar to that previously illustrated and described except for the obvious difference that it is constructed sufficiently large on its interior to accommodate two rolls of wound sheet material. To avoid mere repetition of the structural components heretofore described for the single roll dispenser 10, the same numbers will be employed in describing the multiple roll dispenser embodiment where the function of the elements involved is essentially the same or identical to that previously described.

Thus, the multiple roll dispenser of FIGS. 4, 5 and 6 has a backplate 12, a cover 14 hingedly mounted to the backplate by pivots 18 and the backplate is affixed to a wall W by suitable screws 16. A latch 20 (not shown in detail) serves to retain the cover latched to the upper portion of the backplate 12. An opening 22 is disposed at the bottom of dispenser 10 between the lower end of cover 14 and the bottom of backplate 12. A feed roller 24 is rotatably mounted at the lower end of the dispenser chassis and a pinch roller 28 is mounted on bearing blocks 30 yieldably biased toward the feed roller 24 by a spring 32 at each end of pinch roller 28. As in the previously described embodiment, each spring is mounted on a screw 34 which is secured to the sidewall of the backplate 12.

Again, as in the single roll embodiment described hereinbefore, the lower roll R in dispensing position in the multiple roll dispenser of FIGS. 4, 5 and 6, has cups 36 and 38 which are pressed into the opposite ends of the hollow core of the roll that is located in this dispensing position. Each of the cups has a flange 40 and a central stub shaft 42. Cup 36 has radial fins 44 adapted to engage with radial slots formed at one end of the wound roll of flexible material. As in the previous embodiment, the fins 44 and their engagement with the slots in the core assure that any roll placed in the dispensing position is properly oriented and cannot be inserted backwards which would defeat proper dispensing of the web material from the roll.

As yoke 46 having parallel arms 48 and loops 50 at the outer arm ends has the loops engaged in grooves formed in the periphery of the stub shafts 42 to hold the cups 36 and 38. The inner arm ends are connected by a member 52 to complete the yoke 46. The clips 54 are secured to the backplate 12 of the dispenser chassis by screws 56 to pivotally mount yoke 46 on the backplate.

Again as in the case of the single roll embodiment, a discard area 60 is provided adjacent the lower end of the dispenser 10 into which the spent cores move once the web material has been depleted from the roll with concomitant diminishing of the roll diameter. Incident this roll size decrease, the roll is guided downwardly on yoke 46 through the arcuate path as shown by the arrows on FIG. 1 for the single roll embodiment and on FIG. 4 for the lower roll in the multiple roll embodiment.

Dispensing from the lower roll in the dispensing position of the multiple roll embodiment is identical to that heretofore described with respect to dispensing from the single roll in the single roll embodiment. As the weight of the roll diminishes by the removal of wound web material from the roll, its arcuate path while engaged with the surface of the feed roller 24 makes use of the diminishing weight by wedging the smaller diameter roll down against the feed roller surface through the action of yoke arms 48. Likewise, the wrap or length of the flexible material extending over the surface of feed roller 24 increases as the roll of material diminishes in diameter. This also promotes better assurance of proper feeding of the material M out of the opening 22 at the bottom of the dispenser.

The same conditions occur in the multiple roll embodiment in pressing the roll against the surface of the feed roller and when the axis of the essentially depleted roll has moved to the line extending through the axis of feed roller 24 and the pivotal axis for the yoke 46, the lower roll in dispensing position moves on past and out of engagement with the surface of the feed roller 24 and on into the discard area 60.

The features of the multiple roll dispenser embodiment that give it capability to handle a reserve roll RR include provision of a yoke 64. This yoke is essentially the same as the yoke 46 carrying the lower roll in dispensing position but its mounting on the backplate of the chassis is different to allow this reserve roll RR to move downwardly with its weight resting on the surface of the lower roll R until such time as the essentially depleted lower roll has moved into the discard area 60 whereupon the reserve roll RR then rests its weight on the upper surface of the feed roller 24. Dispensing from reserve roll RR proceeds from thereon with the flexible web material being fed in between the pinch roller 28 and feed roller 24 to thereafter egress from the dispenser opening 22.

The yoke 64 has parallel arms 66 connected by a member 68 at their inner ends adjacent the chassis backplate 12. Each arm 66 has a loop 70 at its outer end which engages in a groove on the stub shaft carried by a cup 72 or 74. The cups 72 and 74 are identical to the cups 36 and 38, respectively, which support the lower roll R. Thus, cup 72 has radial fins to enter radial slots formed in one end of the reserve roll RR and the cups 72 and 74 are pressed into the opposite ends of the core of roll RR.

The support means for the yoke 64 differs substantially from that used to carry and guide movement of the lower roll R as material is depleted therefrom. In supporting yoke 64 the interconnecting member 68 joining the parallel arms 66 is guided down in a vertical direction as material from the lower roll R is depleted and its diameter diminishes. At all times the reserve roll rests its weight on the upper surface of the lower roll R until the lower roll is essentially depleted and it swings into the discard area 60. The direction of rotation of the lower roll R in its engagement with the upper reserve roll RR rotates the reserve roll in the direction of the arrow as shown in FIG. 4. This is important in that the rotation of the reserve roll in this direction tends to wind up the end of the web material on roll RR rather than to promote any unwinding of the end. Once the reserve roll has moved downwardly with the lower roll leaving the dispensing position and going into the discard area then the direction of rotation of feed roller 24 will reverse the rotation of the reserve roll RR for it to rotate counterclockwise such that the free leading end of material on the surface of the reserve roll can be fed over the feed roller 24, between the feed roller and pinch roller 28 and then out through the dispenser opening 22. The manner in which the leading end on the reserve roll RR is picked up once this roll is driving engagement with the feed roller 24 will be described with reference to features of the dispenser chassis which are best illustrated in FIG. 6.

Yoke 64 is mounted for its initial vertical movement down within the chassis to a lower position where the yoke 64 is thereupon confined to be guided in an arc which is spaced from the axis of the feed roller 24. Thereafter, the manner heretofore described for the action of yoke 46 in carrying the roll R in dispensing position through an arc and then into the discard area 60 occurs with yoke 64 and reserve roll RR.

A pair of angle rails 76 are fixed to the backplate 12. As illustrated, the flange of the angle is riveted to the backplate by rivets 78 leaving the other flange extending radially inwardly of the backplate. Thus, rivets 78 fix the angles 76 in parallel relation to each other in the manner as best shown on FIG. 5. The radially inwardly extending flange of each angle 76 is provided with an elongated slot 80. The connecting member 68 for yoke 64 extends through the slots 80 in the parallel angles 76 and thereby fixes the yoke which supports the reserve roll RR for proper guiding movement as it moves down within the dispenser 10. The lower ends 82 of the parallel slots 80 in angles 76 provide a lower position for the reserve roll RR where it no longer moves vertically downwardly but with the yoke member 68 confined within the slots 80 at the lower ends 82, the motion of yoke 64 will commence to follow an arc of movement similar to that which the yoke 46 guided the initial roll R in dispensing position to the discard area 60 for the spent roll core. It will be appreciated that when the yoke 64 has passed all the way down through the length of slots 80 in angles 76 the yoke 46 and essentially depleted roll R will have moved out of the way into the discard area so that the yoke 64 carrying reserve roll RR can progress through a guided arc of movement. This arc is spaced from the axis of the feed roll to achieve the wedging of the surface of roll RR firmly down against the feed roller 24 even as the weight of the reserve roll RR diminishes. As in the case of the initial roll R, the wrap or length of material passing from the reserve roll RR over the feed roller 24 will increase as the roll diameter diminishes and thus the wedging action plus the increasing wrap of material both combine to promote effective dispensing of the material from the reserve roll RR.

Reference may now be made to two elements which are best shown in FIG. 6 that are incorporated in multiple roll dispenser and function to effectively assure that the leading end of the web material is properly fed into the bite between the feed roller 24 and pinch roller 28 for dispensing of material from reserve roll RR out through the dispenser chassis opening 22. To promote effective feeding of the web material from the surface of reserve roll RR the chassis backplate 12 is provided with an inclined guide plate 84. Further, the inside wall of the chassis cover 14 is provided with an abutment 86.

In FIG. 6 the reserve roll RR is shown in its lower dispensing position. The interconnecting member 68 of yoke 64 is disposed in the lower ends 82 of slots 80 and the roll RR is resting in driving engagement with the feed roller 24. Obviously, the essentially exhausted initial roll R has left the dispensing position and swung into the discard area 60. The initial roll leaves the dispensing position and passes beyond the surface of the feed roller 24 shortly before all of the web material is exhausted from the initial roll R. Thus, as shown in FIG. 6, the web material from initial roll R continues to pass from the nearly spent roll R in the discard area, over the feed roller 24 and out through the chassis opening 22. This continued feed of the remaining limited amount of web material from the initial roll R is of assistance in achieving proper start-up of dispensing from the reserve roll RR. The tail end of the web material from the initial roll thus forms a support to pick-up the leading end from the reserve roll and for a short time period of use of material from the dispenser, two layers of material will be fed from the dispenser. This tail end provides a short start-up period for threading the material from the reserve roll. Once reserve roll RR drops into engagement with the feed roller 24 and as the remaining web material is drawn off of the initial roll R, the roll RR will reverse its direction of rotation to rotate counterclockwise for the web material to now unwind from the underside of roll RR over feed roller 24, pass through the nip of rollers 24 and 28 and then out of the dispenser.

Assuming that the end of the web material on the surface of reserve roll RR at the instant that this roll falls down into engagement with the feed roller 24, lies behind the feed roller, the material from roll RR will be guided by guide plate 84 in the manner shown in phantom lines in the left portion in FIG. 6. It will then fall onto the moving web of material coming from the last portion of material on the initial roll R. This web material from the initial roll R will carry it over the feed roller and thence out of the dispenser.

On the other hand, if the web material happens to be in front of the feed roller when the roll RR falls into driving engagement with the feed roller 24, the free end of material on reserve roll RR will engage and be stopped by abutment 86 on the inner front wall of the cover 14, as shown by the phantom line of web material falling off of the front portion of the roll RR. Further, rotation of reserve roll RR and feed roller 24 will cause the material to buckle and form a loop down into the bite between rollers 24 and 28. Thereafter, this folded portion will be conveyed between feed roller 24 and pinch roller 28 and thence pass out of the dispenser through opening 22. As previously mentioned, during the short period until all of the web material is exhausted from the initial roll R, two thicknesses of material will be pulled from the dispenser simultaneously until the material is completely exhausted from the roll now located in the discard area 60.

It is to be understood that the yokes 46 and 64 provide yieldable springing action to their respective arms 48 and 66 such that the flanged cups carried at the outer ends of these arms can be simply spread apart for loading fresh rolls into the dispenser and for removing the core of a spent roll from discard area 60 of the dispenser whether it be the single roll dispenser or multiple roll dispenser. The removal of a spent core and reloading a full roll of material simply involve opening the cover 14, removing the spent core from the yoke 46 and yoke 64, if the reserve roll has also been exhausted. The spent roll core is removed from the particular yoke on which it has been mounted and then discarded. In the single roll embodiment a fresh roll may be applied between the flanged cups on yoke 46 and the cover reclosed. With the multiple roll embodiment, the spend core may likewise be removed from yoke 46 and if the reserve roll RR has not been completely exhausted of material, it may be removed from the upper yoke 64 and loaded into the lower yoke 46. Then a fresh roll of web material will be loaded on the upper yoke 64 to now constitute the new reserve roll.

It will be noted, as shown in FIGS. 1, 4 and 6, that the cover 14 of the dispenser 10, in both the single roll and multiple roll embodiments, is conveniently provided with a sight opening 90. In the single roll embodiment this assists the man servicing the dispensers to visually inspect through sight opening 90 the state of web material supply on the roll in the dispenser without unlatching and opening cover 14. In the multiple roll embodiment the sight opening 90 similarly enables the serviceman to determine expeditiously the supply of material remaining in the dispenser. In the case of the multiple roll dispenser, the sight opening 90 provides a convenience to the serviceman by indicating whether the reserve roll has moved down into dispensing position which would mean that there is a need for reloading the dispenser.

The foregoing sets forth a detailed description of two dispenser embodiments for wound roll flexible sheet material embodying the invention. The two embodiments utilize the same basic concepts for the invention applied to a single roll dispenser or to a multiple roll dispenser. It is to be recognized that various modifications of the dispensers of this invention may occur to those skilled in the art. Therefore, the scope of the invention is to be limited solely by the scope of the appending claims.

I claim:

1. In a dispenser for flexible sheet material having at least one roll of sheet material and mechanism to pass sheet material from the roll out of the dispenser, a method for promoting feeding of sheet material from the roll and out of the dispenser comprising the steps of:

resting the roll surface on a feed roller;

passing sheet material from the roll between the roll surface and the feed roller to rotate the roll and feed roller incident withdrawal of material from the roll;

guiding downward movement of the roll through an arc spaced from the axis of the feed roller as the roll diameter diminishes incident depletion of material on the roll to increase driving pressure between the roll and feed roller surfaces; and passing the essentially depleted roll past the feed roller surface of discard.

2. The method of claim 1 further comprising:

resting the surface of a reserve roll on the upper surface of an initial roll;

guiding downward generally vertical movement of the reserve roll to a lower position as the initial roll is depleted of material; and guiding downward movement of the reserve roll through an arc similarly located to the arc which the initial roll moved through while said reserve roll is resting on said feed roller after the essentially depleted initial roll has passed to discard.

3. A dispenser for flexible sheet material comprising:

a chassis adapted to be attached to a wall at a location for sheet material use;

a feed roller mounted to rotate near the lower end of said chassis;

dispensing arm means pivotally connected to said chassis and having roll mounting means thereon to engage with the ends of and rotatably support a roll of sheet material to locate the roll surface resting on said feed roller, said dispensing arm means acting to guide the roll axis through an arc spaced from the axis of the feed roller as material on the roll is depleted with concomitant diminishing roll diameter to wedge the roll surface firmly against the surface of said feed roller.

4. A dispenser as recited in claim 3 wherein said chassis includes a back-plate having means to facilitate connecting the dispenser to a wall and a cover to enclose the roll and elements affixed to the chassis, said chassis providing an opening adjacent its lower end for egress of flexible sheet material incident use of such material.

5. A dispenser as recited in claim 3 wherein said dispensing arm means consists of a yoke having generally parallel arms extending outwardly from the ends of a member interconnecting said arms, supports pivotally mounting said interconnecting member are fastened to said chassis, and a core engaging member to enter the roll core end is provided adjacent the outer end of each said arm, said core engaging members forming said roll mounting means and facing toward each other to enter into the opposite ends of a roll core in rotatably supporting a roll.

6. A dispenser as recited in any one of claims 3, 4 or 5 wherein there is further provided a yieldably and rotatably mounted pinch roller biased against the surface of said feed roller with the sheet material from the roll adapted to pass between said rollers after being withdrawn from the roll and before egress from the dispenser for use.

7. A dispenser as recited in any one of claims 4 or 5 wherein reserve arm means is mounted on said chassis disposed above said dispensing arm means and having reserve roll mounting means thereon to engage with the ends of and rotatably support a reserve roll to locate the reserve roll above and resting on the roll therebelow, support means connected to said chassis mounting said reserve arm means to move down generally vertically relative to said chassis as the roll therebelow is depleted, said support means having a lower position confining said reserve arm means to guide the reserve roll axis through an arc spaced from the axis of the feed roller when the roll therebelow is essentially depleted to move past and out of engagement with said feed roller whereupon the reserve roll engages with said feed roller and sheet material is thereafter removed from the reserve roll by the material passing between the reserve roll surface and the surface of said feed roller for egress of material from the dispenser incident use of such material.

8. A dispenser as recited in claim 3 wherein reserve arm means is mounted on said chassis disposed above said dispensing arm means and having reserve roll mounting means thereon to engage with the ends of and rotatably support a reserve roll to locate the reserve roll above and resting on the roll therebelow, support means connected to said chassis mounting said reserve arm means to move down generally vertically relative to said chassis as the roll therebelow is depleted, said support means having a lower position confining said reserve arm means to guide the reserve roll axis through an arc spaced from the axis of the feed roller when the roll therebelow is essentially depleted to move past and out of engagement with said feed roller whereupon the reserve roll engages with said feed roller and sheet material is thereafter removed from the reserve roll by the material passing between the reserve roll surface and the surface of said feed roller for egress of material from the dispenser incident use of such material.

9. A dispenser as recited in claim 8 wherein said support means for said reserve arm means includes bracket means fastened to said chassis having generally vertical slot means in which said reserve arm means is received to be guided downwardly as the material on the roll below the reserve roll is depleted with concomitant diminishing roll diameter, the lower portion of said slot means defining said lower position whereat said reserve arm means is confined to guide the reserve roll axis through the arc for the reserve roll.

10. A dispenser as recited in any one of claims 8 or 9 wherein said reserve arm means consists of a yoke having generally parallel arms extending outwardly from the ends of a member interconnecting said arms, said interconnecting member being engaged with said support means for said reserve arm means.

11. A dispenser for flexible sheet material comprising:

a chassis adapted to be attached to a wall at a location for flexible sheet material use;

a feed roller operably connected to said chassis and mounted to rotate near the lower end of the chassis;

mounting means operably connected to said chassis and engagable with a roll of flexible sheet material to rotatably mount said roll and locate the surface thereof against the surface of said feed roller, said mounting means and feed roller being positioned with respect to each other so that upon removal of the flexible sheet material from said roll, the roll will be wedged against the feed roller.

12. A dispenser as recited in claim 11, wherein during dispensing of flexible sheet material from said roll, said material is at least partially wrapped around said feed roller surface, and wherein said mounting means and feed roller are positioned with respect to each other so that upon removal of the flexible sheet material from said roll, the length of said material wrapped around the feed roller surface is increased.

* * * * *